US007712169B2

(12) United States Patent
Kovalyak

(10) Patent No.: US 7,712,169 B2
(45) Date of Patent: May 11, 2010

(54) INFANT PILLOW DEVICE

(76) Inventor: Nicole L. Kovalyak, 1702 Treasure Lake, Dubois, PA (US) 15801

( * ) Notice: Subject to any disclaimer, the term of this patent is extended or adjusted under 35 U.S.C. 154(b) by 103 days.

(21) Appl. No.: 12/007,568

(22) Filed: Jan. 11, 2008

(65) Prior Publication Data

US 2009/0178202 A1 Jul. 16, 2009

(51) Int. Cl.
*A47C 20/02* (2006.01)

(52) U.S. Cl. ..... 5/655; 5/725; 5/731; 5/736; 5/652.1; 5/637; 5/638

(58) Field of Classification Search ..... 5/655, 5/644, 637, 638, 690, 724, 725, 731–736, 5/652, 652.1
See application file for complete search history.

(56) References Cited

U.S. PATENT DOCUMENTS

| | | | | |
|---|---|---|---|---|
| 5,092,005 | A | 3/1992 | Byrn | |
| 5,279,310 | A * | 1/1994 | Hsien | 5/632 |
| 5,339,472 | A | 8/1994 | Yin | |
| 5,519,906 | A | 5/1996 | Fanto-Chan | |
| 5,524,640 | A * | 6/1996 | Lisak et al. | 5/655 |
| 5,551,109 | A | 9/1996 | Tingley et al. | |
| 5,581,833 | A * | 12/1996 | Zenoff | 5/655 |
| 5,675,853 | A | 10/1997 | Linge | |
| 5,916,089 | A * | 6/1999 | Ive | 5/655 |
| 6,154,903 | A * | 12/2000 | Wai-Chung | 5/632 |
| 6,233,768 | B1 * | 5/2001 | Harding | 5/735 |
| 6,321,403 | B1 * | 11/2001 | Matthews | 5/655 |
| 6,412,128 | B1 | 7/2002 | Matthews | |
| 6,499,165 | B1 | 12/2002 | Morgillo | |
| 6,539,567 | B1 | 4/2003 | Bae | |
| 6,564,408 | B2 | 5/2003 | Van Vuuren | |
| 6,651,282 | B1 | 11/2003 | Skoug et al. | |
| 6,842,925 | B1 | 1/2005 | Owens et al. | |
| 6,868,566 | B2 * | 3/2005 | Gatten | 5/494 |
| 7,000,275 | B2 | 2/2006 | Matthews Brown et al. | |
| 7,003,831 | B1 | 2/2006 | Goutevenier-Reyher | |
| 7,127,760 | B2 | 10/2006 | Bartley et al. | |
| 2005/0210592 | A1 * | 9/2005 | Littlehorn et al. | 5/655 |
| 2005/0225137 | A1 | 10/2005 | Mead et al. | |
| 2006/0010605 | A1 | 1/2006 | Kamrin-Balfour | |
| 2006/0207029 | A1 | 9/2006 | Bell | |
| 2007/0094799 | A1 * | 5/2007 | Wilson | 5/639 |

* cited by examiner

*Primary Examiner*—Darnell Jayne
*Assistant Examiner*—William Kelleher
(74) *Attorney, Agent, or Firm*—Klima Law Offices, PLLC

(57) ABSTRACT

An infant pillow device including a head and neck positioner (s) for retaining the infant's head and neck to prevent lateral, upwardly, downwardly, and rotational movement of the infants head. The infant pillow device aligns the infant's head, neck and spine when positioned on the infant pillow device.

14 Claims, 3 Drawing Sheets

INFANT PILLOW DEVICE

FIELD OF THE INVENTION

The present invention is directed to an infant pillow device, in particular an infant pillow device for use in prenatal care as a developmental positioning aid.

BACKGROUND OF THE INVENTION

There exists various pillows for supporting an infant, in particular a newborn. These devices provide some level or degree of use for infants; however, these devices tend to be unsuitable in various ways as a developmental positioning aid for administering prenatal care.

There exists a need for an infant pillow device configured to provide a developmental positioning aid for administering prenatal care. Such an infant pillow device would be configured to stabilize and align the infant's neck, spine and head, and encourage the fetal position. Further, it is desirable that such an infant pillow device is comfortable to the infant.

SUMMARY OF THE INVENTION

An object of the present invention is to provide an improved infant pillow device.

A second object of the present invention is to provide an infant pillow device configured to stabilize and align the infant's neck, spine and head.

A third object of the present invention is to provide an infant pillow device having an opening for receiving at least a portion of the infant's head for stabilizing the infant's head.

A fourth object of the present invention is to provide an infant pillow device including a neck stabilizer for stabilizing and supporting the infant's neck.

A fifth object of the present invention is to provide an infant pillow device including a neck stabilizer provided by at least one simulated breast portion.

A sixth object of the present invention is to provide an infant pillow device including a neck stabilizer provided by a pair of simulated breast portions.

A seventh object of the present invention is to provide an infant pillow device including an opening for stabilizing an infant's head in combination with a neck stabilizer for stabilizing the infant's neck.

An eighth object of the present invention is to provide an infant pillow device including an opening for receiving and stabilizing an infant's head in combination with a neck stabilizer positioned adjacent the opening in the pillow.

A ninth object of the present invention is to provide an infant pillow device including the combination of an infant's head stabilizer, infant neck stabilizer, and infant spine stabilizer for aligning the head, neck, and spine of an infant.

A tenth object of the present invention is to provide an infant pillow device including an opening provided by a through hole in the pillow device configured for stabilizing an infant's head.

An eleventh object of the present invention is to provide an infant pillow device including a through hole configured for stabilizing an infant's head, the pillow device configured to selectively open and close the through hole in the pillow device for accommodating tubes and/or wires for treatment of the infant.

A twelfth object of the present invention is to provide an infant pillow device including an infant's head stabilizer including a through hole in the pillow device in combination with a head cushion portion configured for cradling an upper portion of the infant's head.

The infant pillow device according to the present invention is preferably configured to provide a developmental positioning aid. Preferably, the infant pillow device is configured to provide alignment of the infant's head, neck and spine. Further, it is preferable that the infant pillow device encourages the fetal position of the infant.

The infant pillow device according to the present invention can provide swaddling for the infant, for example, with straps. The infant pillow device according to the present invention eliminates head molding "toaster heads" to increase cognitive development of the infant. Specifically, the alignment of the head, neck and spine provides airway alignment decreasing oxygen needs of the infant and intracranial pressure. Prone position (with face straight down) of infant with head in correct alignment decreases the pressure causing intraventricular hemorrhage. Further, the comfortable configuration of the infant pillow device according to the present invention also leads to decreased oxygen needs of the infant, increased sleep time, increased growing time, increased feedings of the infant, and increased good feelings of the infant. The infant pillow device according to the present invention also decreases skin break down by the infant willing to reposition himself or herself due to comfort provided by the infant pillow device.

The infant pillow device according to the present invention assists the infant developmentally from the advantage of "kangaroo care" position. This pillow encourages the infant to be in an "in utero" position by sitting the infant up slightly as it would be in utero with the bottom portion allowing the infant to kick out it's legs and pull back as it would in utero. The nurse can "swaddle" the infant with one or more straps (e.g. three (3) three straps) included with the infant pillow device, also giving an in utero feel for the infant. Therefore, the infant pillow device according to the present invention aids in the cognitive and the physical development of the infant.

For nurses working with infants, the infant pillow device according to the present invention helps nurses treat the infant by decreasing oxygen need, therefore decreasing apneas and bradycondia. This allows the infant to rest more. Further, the infant pillow device according to the present invention provides the nurse with various options for positioning the infant. The infant pillow device according to the present invention also makes it easy for the nurse to get the infant.

The infant pillow device according to the present invention allows the infant to be positioned on either side, supine (back down), or prone (chest down). For the side positions, a lower portion of the infant pillow device uses one or more straps to swaddle the infant. A little round pillow, stored in an accessory pocket of the infant pillow device, can be provided for the infant to "hug." For the supine (back down) position, the infant pillow device can provide a sniffing position for the infant's head therebetween. The infant's legs may be retained in a lower pouch provided in the infant pillow device, or can be positioned on top of the pouch if a UA line is present in the infant. Again, the straps may be used to swaddle the infant. For the prone (chest down) position, a lower portion of the head positioner allows the head to be turned to either side. Again, the one or more straps may be used to swaddle the infant. An optional crescent-shaped insert may be used for the sternum or chest support if needed. For face straight down in the prone position, the infant's head is located on an upper part of the head positioner using an insert to adjust the infant's head for support. Again, one or more straps may be used to swaddle the infant. Also, the cresant-shaped insert may be used in between breast and upper surface of the infant pillow device to "build up" support for the chest while face down on the abdomen.

The infant pillow device according to the present invention can be made from a single piece of material (e.g. molded foam), or a combination of parts or components assembled together, for example, by sewing panels of fabric together. In a preferred embodiment, the pillow device includes an inner pillow support covered by an outer pillow cover. The pillow support, for example, can be made of foam, fiber, down, or other suitable filling material. The pillow cover is preferably a soft cloth material such as flannel or terry cloth.

A preferred infant pillow device according to the present invention includes a head postioner. For example, the infant pillow device is provided with an opening for receiving at least a portion of the infant's head. The opening in the infant pillow device is preferably a through hole configured (e.g. sized and shaped) to accommodate at least a portion of the infant's head. For example, when the infant is laid supine face up on his on her back, a back portion of the head is received within the through hole. Alternatively, the infant can be laid prone face down on his or her abdomen with the infant's eyes, nose, and mouth located to either side, or downwardly in the through hole. The through hole stabilizes the infant's head and prevents both lateral and upwardly/downwardly movement of the infant's head. The through hole also restricts rotational or turning movement of the infant's head. In a preferred embodiment, the through hole is located along a central longitudinal axis of the infant pillow device, and located towards an upper end thereof to accommodate the infant laying on the infant pillow device.

In a preferred embodiment of the infant pillow device according to the present invention, the through hole is configured to be opened and closed to allow tubes and other lines for treating the infant to be placed and removed into and out of the through hole. For example, a slot can be made to extend through the thickness of the infant pillow device, and extend from the through hole to an outer edge (e.g. side edge) of the infant pillow device. A closure device such as a flap with a hook and loop fastener (e.g. Velcro) can be provided to open and close the slot leading into the through hole from an edge of the infant pillow device. The flap is preferably a netting type material to allow viewing of the infant head/face when located in the through hole.

In a preferred embodiment, the infant pillow device is provided with a headrest, preferably located adjacent, centered, and above the through hole. The headrest further cushions and restrains the infant's head from lateral movement, upwardly movement, and/or rotational or turning movement of the infant's head. The headrest is preferably cresant-shaped to partially wrap around an upper back portion of the infant's head when laying on its back or an upper front portion of the infant's head when the infant is laying face down on the infant pillow device.

In a preferred embodiment, the infant pillow device is provided with a neck positioner for stabilizing and restraining the infant's neck from lateral movement. The combination of the through hole, headrest, and neck positioner aligns the infant's head, neck and spine. A preferred neck positioner is at least one simulated breast portion, and more preferably a pair of simulated breasts portions located adjacent, centered, and below the through hole. The simulated breast portions cushion the infant's neck, and comfort the infant due to the shape and size of the simulated breast portions. The simulated breast portions, for example, can be made of fabric or cloth material the same or different from the cloth material used to make the main pillow of the infant pillow device. The simulated breasts can be filled with suitable foam and/or fiber to facilitate simulating a pair of breast portions.

The main pillow of the infant pillow device can be provided with one or more transverse pleats extending across the width of the main pillow at one or more locations along the length thereof. The pleats enhance the flexibility and comfort of the main pillow.

In a preferred embodiment, the infant pillow device is provided with a feet positioner. A preferred feet position is a pouch, for example, a cloth pouch provided at a lower end of the main pillow to comfortably restrain the feet of the infant to restrict movement thereof. The pouch allows the infant's feet to move around to a certain degree to provide comfort. For example, the pouch can include an elastic upper band to facilitate retaining the feet of the infant.

The bottom end edge of the main pillow can be provided with a pocket, for example, a zippered pocket to provide storage for accessories such as one or more cloth straps for swaddling the infant, and the optionally crescent-shaped insert for use in the through hole to decrease size thereof, or used between through hole and neck positioner to further support portion of infant's head. The zippered pocket can be accessible from the bottom edge of the main pillow of the infant pillow device. In addition, a cloth strap can be sewn at one edge to a side edge of the main pillow portion to swaddle infant's feet, legs, and body. The cloth strap can be provided with a hook and loop fastener (e.g. Velcro) for attaching to a portion of the main pillow and adjusting the length of the cloth strap. The cloth strap extends across the width of the main pillow with one end sewn to a side edge of the main pillow and the hook and loop faster located on the opposite end of the cloth strap and opposite side edge of the main pillow.

In a preferred embodiment, the main pillow is made of a soft cloth (e.g. flannel, terry cloth), which is cut into cloth panels, and then sewn together. The outer cloth covering after assembly, is then filled with foam and/or fiber filling to make the main pillow. The simulated breast portions are preferably made from separate cloth panels that are sewn to the main pillow portion and then stuffed with filling material. The cresant-shaped headrest is also made from a separate panel of cloth material, stuffed and sewn to the main pillow at a position adjacent, above, and centered relative to the through hole.

DETAILED DESCRIPTION OF THE PREFERRED EMBODIMENTS

Figure 1:
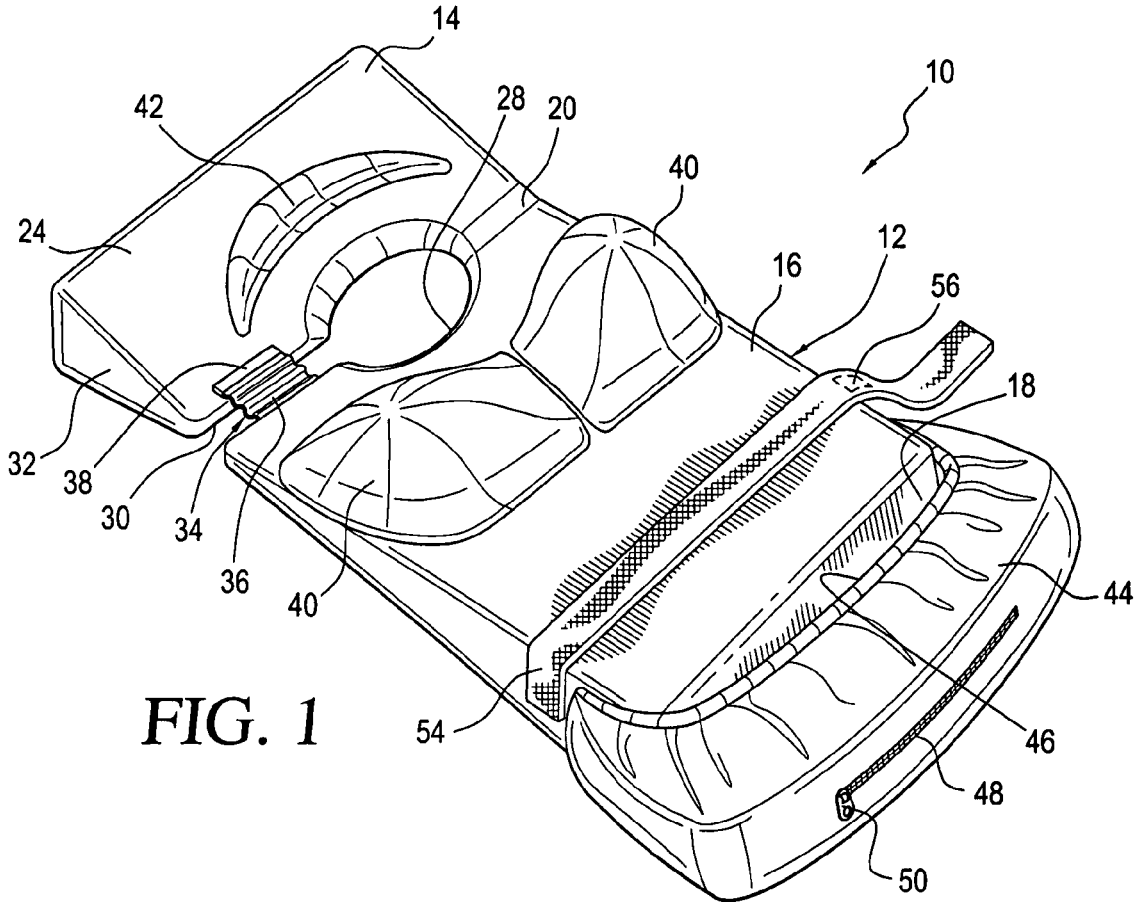
FIG. 1 is a perspective view of the infant pillow device according to the present invention.
Figure 2:
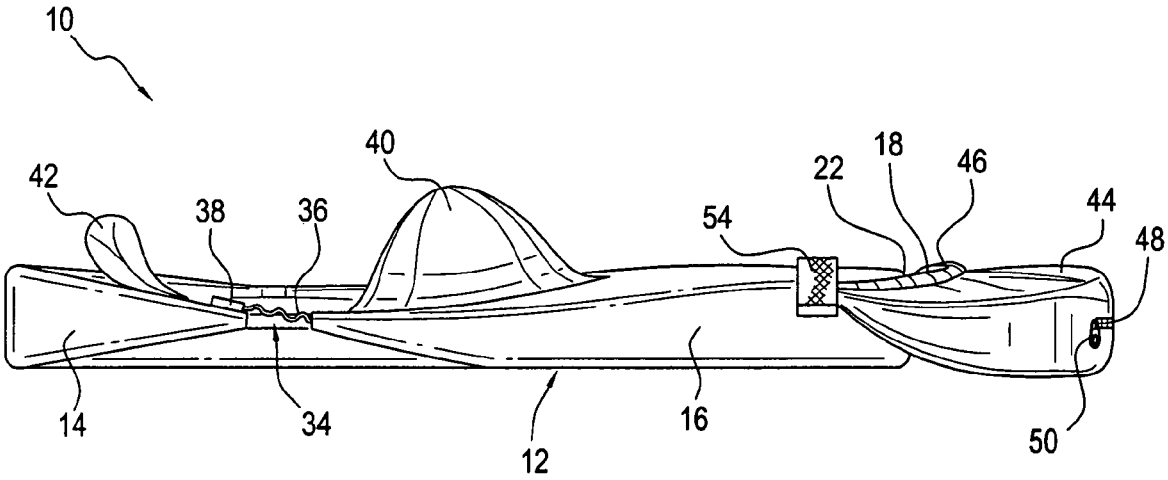
FIG. 2 is a side elevational view of the infant pillow device shown in FIG. 1.
Figure 3:
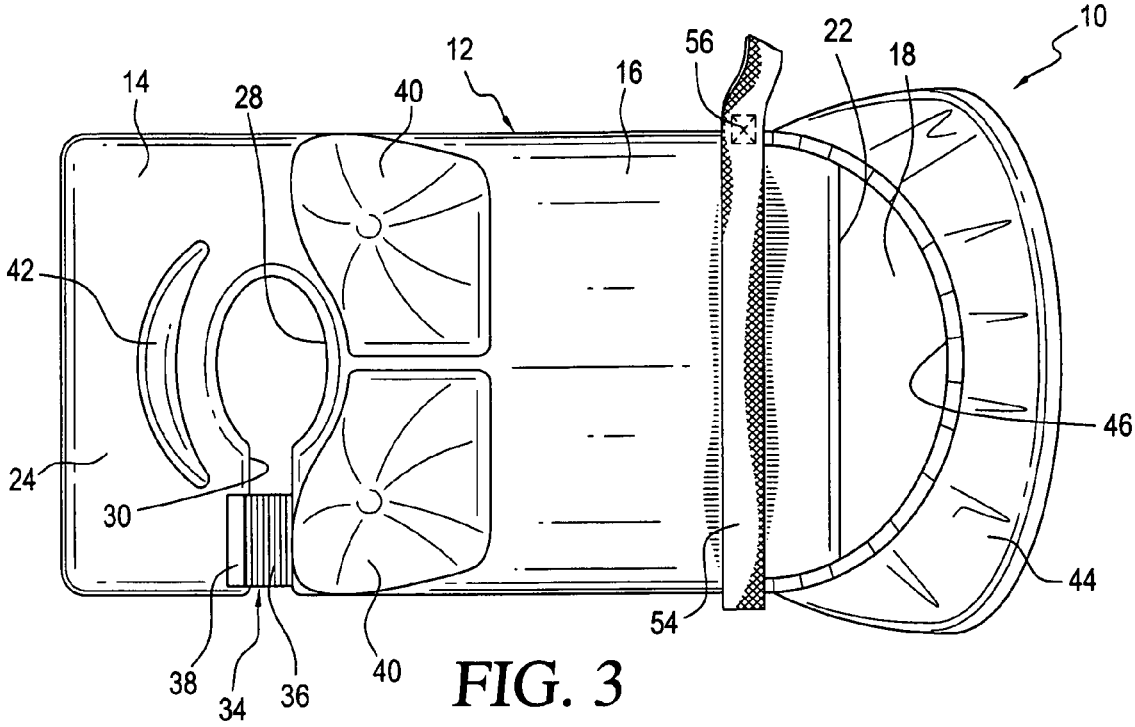
FIG. 3 is a top planar view of the infant pillow device shown in FIG. 1.
Figure 4:
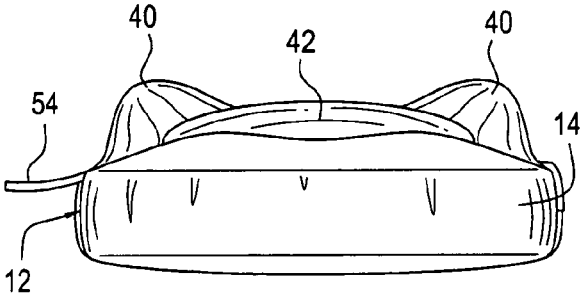
FIG. 4 is a top elevational side view of the infant pillow device shown in FIG. 1.
Figure 5:
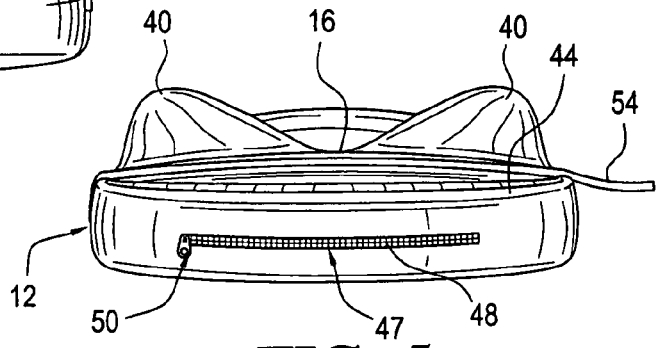
FIG. 5 is a bottom and elevational side view of the infant pillow device shown in FIG. 1.
Figure 6:
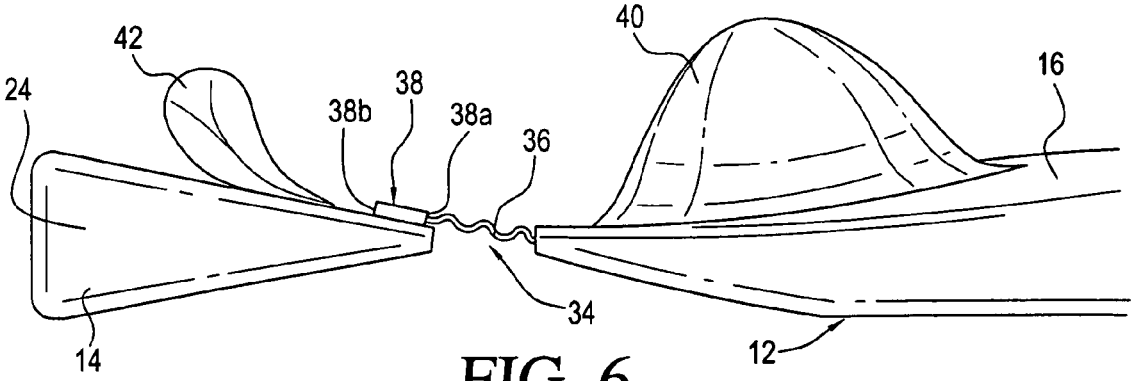
FIG. 6 is a detailed view of the slot closure of the infant pillow device shown in FIG. 1.
Figure 7:
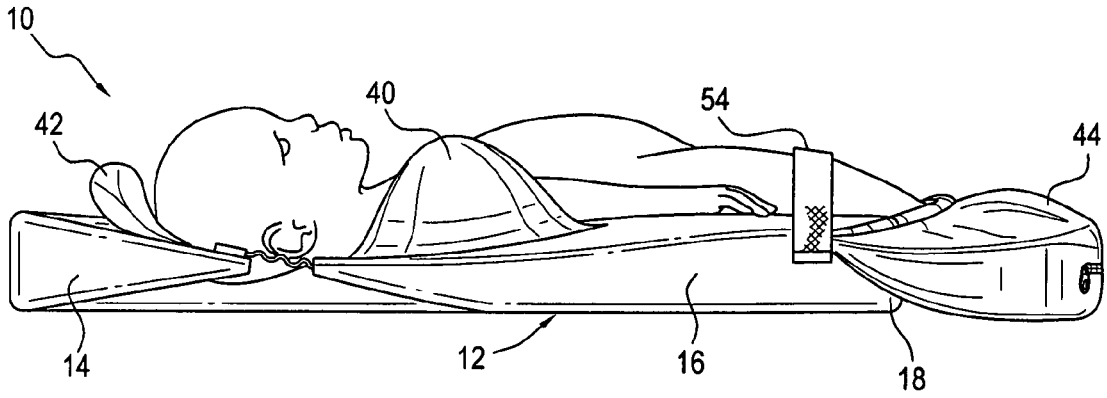
FIG. 7 is a perspective view of the infant pillow device shown in FIG. 1 with an infant in a supine face up position.
Figure 8:
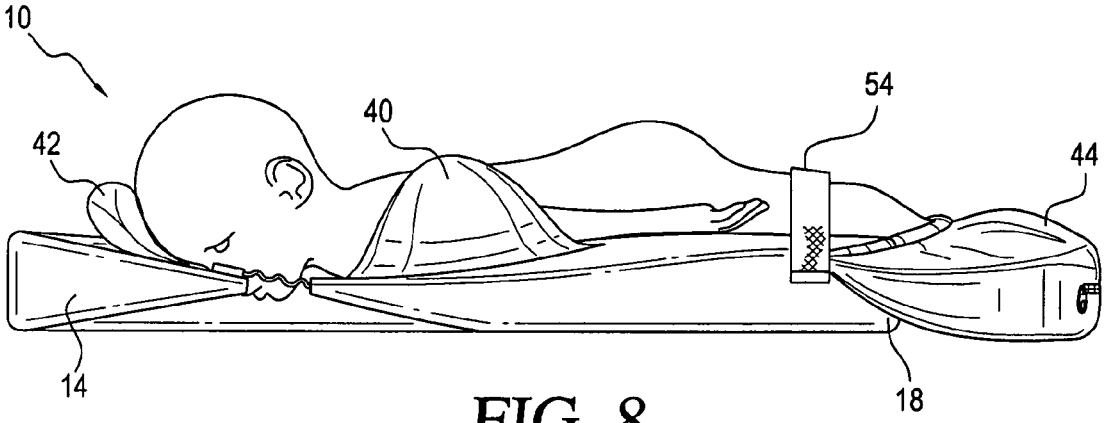
FIG. 8 is a perspective view of the infant pillow device shown in FIG. 1 with an infant shown in a prone face down position.

A preferred embodiment of the infant pillow device 10 according to the present invention is shown in FIGS. 1-6.

The infant pillow device 10 includes a main pillow 12 having an upper head supporting pillow portion 14, a middle body supporting pillow portion 16, and a lower feet supporting pillow portion 18. The main pillow 12 is divided into the three pillow portions 14, 16, 18 by upper lateral pleat 20 and lower lateral pleat 22.

Figure 9:
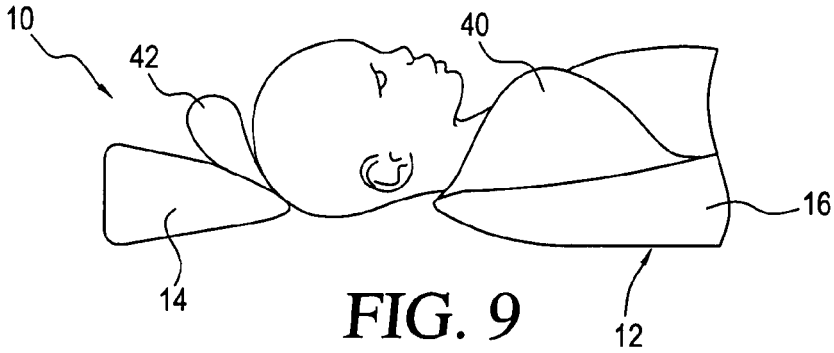
FIG. 9 is a cross-sectional view as indicated in FIG. 1 showing an infant resting on the infant pillow device with the head, neck and feet restrained from movement.

The main pillow 12 is constructed of an outer fabric cover 24 and filled with a filler such as foam, foam particles, down, and/or fiber fill 26 (See FIG. 9).

The main pillow 12 is provided with an opening provided by a through hole 28 extending through the thickness of the main pillow 12. The through hole 28 is sized and shaped so as to accommodate a back portion, side portion, or front portion of an infant's head to retain same, and restrain the infant's head from lateral movement, upwardly/downwardly movement, and/or rotational or turning movement of the infant's head. For example, when an infant is laying supine face up on the infant pillow device 10, a back portion or side portion of the infant's head fits into the through hole 28. When the infant is laying prone face down on the infant pillow device 10, the front portion of the infant's head including the eyes, nose and mouth or a side portion of the infant's head is located in an upper portion of the through hole 28 to allow the infant to properly breath through his or her nose and/or mouth.

A slot 30 extends through the thickness of the main pillow 12, and extends from the through hole 28 to a side edge 32 of the main pillow 12. The slot 30 allows tubes and/or lines for treating the infant (e.g. feeding tube, electrical wires for monitoring device) to fit through the slot 30 into the through hole 28 when the infant is located on the infant pillow device 10 face down.

The main pillow 12 is provided with a closure 34 for opening and closing the through hole 28. For example, the closure 34 is a flap 36 sewn to the upper edge of the middle pillow 16 of the main pillow 12, and extending across the slot 30 to a lower edge of the head pillow 14. The flap 36 and upper head supporting pillow portion 14 are provided with a hook and loop fastener 38 sewn in part to the flap 36 and sewn in part to the head pillow portion 14 to allow the flap 36 to be opened and closed to open and close the slot 30. Thus, once tubes and/or wires are passed through the slot 30 into the through hole 28, the closure 34 can be closed to retain same within the through hole 28. To remove the tubes and/or wires, the closure 34 is again opened.

The main pillow 12 is provided with a pair of simulated breast portions 40, 40 configured and constructed to simulate a mother's breast to the infant. The infant's head is supported in the center of the breast portions 40, 40 along the longitudinal centerline of the main pillow 12 so that the infant's neck is restrained from lateral movement and/or rotational movement. The breast portions 40, 40 are located adjacent, centered, and below the through hole 28. The combination of the through hole 28, and breast portions 40, 40 significantly retains and restrains the infant's head, neck and spine from lateral movement, upwardly/downwardly, and/or rotational movement.

The head supporting pillow portion 14 is provided with a cresant-shaped headrest 42, and positioned adjacent and above the through hole 28. The headrest 42 grips an upper front portion, upper side portion, or upper back portion of the infant's head, depending on the infant's orientation, to further retain and restrain the infant's head from lateral movement, upwardly movement, and rotational movement. The breast portions 40, 40 restrict the infant's head from downward movement. Thus, the combination of the breast portions 40, 40 and head rest 42 effectively prevent upwardly or downwardly movement of the infant during use while providing a substantial restraint from lateral and rotational head movement.

The lower pillow portion 18 is provided with a pouch 44 for retaining the infant's feet. The pouch 44 is a layer of material sewn around the lower edges of the lower pillow portion 18. The pouch 44 is provided with an elastic edge 46 to further maintain the infant's feet within the pouch 44.

Figure 10:
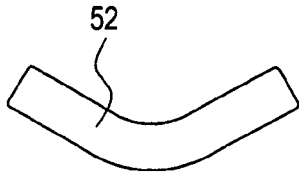
FIG. 10 is a top planar view of an optional cresant-shaped insert for use in or adjacent the through hole of the infant pillow device.

The lower edge of the lower pillow portion 18 is provided with a storage pouch 47 having a zipper 48 (FIG. 5) having a zipper pull 50. Accessories, for example, one or more optional straps for swaddling the infant can be stored in the storage pouch 47. In addition, one or more inserts for use in or around the through hole 28 can be stored in the storage pouch 47. For example, a cresant-shaped insert 52 (FIG. 10) can be stored in the storage pouch 47. The insert 52, for example, can be made of cloth and stuffed with filling. An optional bendable rod or strip (e.g. copper or aluminum strip or rod) can be sewn inside the insert 52 to allow the shape of the insert to be changed (e.g. straight, more bent, less bent). The insert 52 is fitted into or adjacent the through hole 28 to reduce the size of the through hole 28, and/or further support the infants head and/or neck). For example, the insert 52 can be fitted between the upper portion of the infant' neck adjacent the through hole 28 to lift the infant's head slightly out of the through hole 28 for adjusting the support of the infant's head within the through hole 28.

The infant pillow device is provided with an adjustable length strap 54. The strap 54, for example, can be made of a cloth panel folded over and sewn along the edges. One end of the strap 54 is sewn to the main pillow 12 (e.g. lower pillow portion 18), and the opposite end is provided with a hoop and loop fastener 56 (e.g. Velcro) for securing and adjusting the length of the strap 54. Specifically, one portion of the hook and loop fastener 56 is sewn to the strap 54, and the other portion of the hook and loop fastener 56 is sewn to an edge of the main pillow 12 opposite to the edge that the strap 54 is sewn. The length of the hook and loop fastener 56 is sufficient that the length of the strap 54 can be adjusted by the respective positioning of the portions of the hook and loop fastener 56 when the strap 54 is secured to the main pillow 12.

In use, the infant pillow device 10 is placed on a table or other suitable support. The infant is laid on the infant pillow device 10 supine, prone, or on the infant's side. The infant's head is positioned over the through hole 28, and the infant's neck is placed between the pair of breast portions 40, 40. Optionally, the infant's feet can be place on top of or inside the pouch 44. The cloth strap is fitted over the infant's body to swaddle the infant.

In the event treatment tubes, lines and/or wires are required when the infant is laying prone, the closure 34 is opened and the treatment tube, lines and/or wires are inserted through the slot 30 into the through hole 28.

The invention claimed is:

1. An infant pillow device comprising: a main pillow having an infant head positioner provided by a through hole configured to accommodate and retain at least a portion of an infant's head; and an infant neck retainer provided by a pair of protrusions connected to said main pillow, said neck retainer positioned adjacent and below said opening in said main pillow and located adjacent to a neck of an infant when the infant is positioned on said infant pillow device, said through hole and said neck retainer configured to stabilize and retain said infant's head and neck to prevent lateral, upward, downward, and rotational movement of the infant's head, and to align the infant's head, neck, and spine; said pillow is provided with a slot extending through a thickness of said pillow, said slot further extending from said through hole to an edge of said pillow, and a closure connected to said pillow, said closure configured to open and close said through hole.

2. An infant pillow device comprising: a main pillow having an infant head positioner provided by a through hole configured to accommodate and retain at least a portion of an infant's head; and an infant neck retainer provided by a pair of protrusions connected to said main pillow, said neck retainer positioned adjacent and below said opening in said main pillow and located adjacent to a neck of an infant when the infant is positioned on said infant pillow device, said through hole and said neck retainer configured to stabilize and retain said infant's head and neck to prevent lateral, upward, downward, and rotational movement of the infant's head, and to align the infant's head, neck, and spine; said pillow is provided with a slot extending through a thickness of said pillow, said slot further extending from said through hole to an edge of said pillow, a closure connected to said pillow, said closure configured to open and close said through hole, and a headrest connected to said main pillow, said headrest positioned adjacent and above said through hole.

3. A device according to claim 1, including a headrest connected to said pillow, said head rest positioned above said opening is said pillow, said headrest configured to stabilize the infant's head to prevent movement.

4. A device according to claim 1, wherein said closure includes a hook and loop type fastener configured to open and close said slot.

5. A device according to claim 4, wherein said closure includes a flap configured to open and close said slot, one portion of said hook and loop fastener connected to said flap and another portion of said hook and loop fastener connected to said pillow adjacent said slot.

6. A device according to claim 1, wherein said pillow is a rectangular-shaped pillow.

7. A device according to claim 1, wherein said pillow includes an outer cover and an inner support.

8. A device according to claim 7, wherein said outer cover is a removable and washable cloth cover, anti said inner support is fiber filler.

9. A device according to claim 1, wherein said pillow is a rectangular-shaped pillow and said through hole is off center in a length dimension of said pillow and centered in a width dimension of said pillow.

10. A device according to claim 1, wherein said pillow includes an outer fabric cover and an inner support, said pair of protrusions includes an outer fabric cover sewn to said outer fabric cover of said pillow, said pair of protrusions including an inner support.

11. A device according to claim 10, wherein said inner support of said pair of protrusions is a foam support.

12. A device according to claim 1, including a pouch connected to said pillow, said pouch position at bottom of said pillow, said pouch configured to capture the infant's feet.

13. A device according to claim 12, wherein said pouch includes an elastic edge to retain the infant's feet inside said pouch.

14. A device according to claim 12, wherein said pouch extends upwardly from a lower edge of said pillow, and also extends a width dimension of said pillow.

* * * * *